US010352061B2

(12) United States Patent
Geslin

(10) Patent No.: US 10,352,061 B2
(45) Date of Patent: Jul. 16, 2019

(54) SYSTEM FOR ANCHORING A POLE INTO THE GROUND COMPRISING AT LEAST ONE INTERFACE LIKELY TO BE ASSEMBLED ON AN ANCHORING BASE INTENDED TO BE FLUSH WITH THE GROUND

(71) Applicant: EYES GROUP, Angers (FR)

(72) Inventor: Arnaud Geslin, Le Lion d'Angers (FR)

(73) Assignee: EYES GROUP, Angers (FR)

( * ) Notice: Subject to any disclaimer, the term of this patent is extended or adjusted under 35 U.S.C. 154(b) by 0 days.

(21) Appl. No.: 15/763,317

(22) PCT Filed: Sep. 19, 2016

(86) PCT No.: PCT/FR2016/052365

§ 371 (c)(1),
(2) Date: Mar. 26, 2018

(87) PCT Pub. No.: WO2017/051099

PCT Pub. Date: Mar. 30, 2017

(65) Prior Publication Data

US 2018/0283033 A1 Oct. 4, 2018

(30) Foreign Application Priority Data

Sep. 25, 2015 (FR) ..... 15 59091

(51) Int. Cl.
*E04H 12/22* (2006.01)

(52) U.S. Cl.
CPC ..... *E04H 12/2223* (2013.01); *E04H 12/223* (2013.01); *E04H 12/2215* (2013.01); *E04H 12/2269* (2013.01)

(58) Field of Classification Search
CPC ..... E04H 12/2223; E04H 12/2269
See application file for complete search history.

(56) References Cited

U.S. PATENT DOCUMENTS 4,133,154 A * 1/1979 Ruzicka ..... E02D 27/42 52/100
5,752,349 A * 5/1998 Fitzsimmons ..... A63B 71/023 248/156

(Continued)

FOREIGN PATENT DOCUMENTS

DE 19634306 A1 2/1998
DE 29916824 U1 1/2000

(Continued)

OTHER PUBLICATIONS

International Search Report dated Nov. 17, 2016 for corresponding International Application No. PCT/FR2016/052365, filed Sep. 19, 2016.

(Continued)

*Primary Examiner* — Rodney Mintz
(74) *Attorney, Agent, or Firm* — David D. Brush; Westman, Champlin & Koehler, P.A.

(57) ABSTRACT

A system for anchoring a pole into the ground includes an anchoring base intended to be anchored into the ground, the anchoring base exhibiting a high, flush end intended to be flush with the ground; at least one interface exhibiting a housing capable of holding a pole, the interface having elements for holding a pole inserted in the housing thereof; and elements for assembling/disassembling the interface on the anchoring base.

10 Claims, 5 Drawing Sheets

(56) References Cited

U.S. PATENT DOCUMENTS 6,098,353 A * 8/2000 Stanfield ..... E01F 9/685 52/169.13
6,991,413 B2 * 1/2006 Ballou ..... F16B 13/063 411/15
7,055,807 B2 * 6/2006 Pesta ..... E04H 12/2269 160/351
D550,072 S * 9/2007 Ardern ..... D8/387
7,325,790 B2 * 2/2008 Lee ..... E02D 27/42 256/65.14
2003/0121223 A1 * 7/2003 Riker ..... E04H 12/2269 52/296
2003/0205647 A1 * 11/2003 Boucher ..... A01G 9/122 248/156
2003/0222253 A1 * 12/2003 Langlie ..... A01K 3/00 256/10
2004/0163336 A1 8/2004 Hsu
2005/0040297 A1 * 2/2005 Saraf ..... E04H 12/2223 248/156
2005/0116133 A1 * 6/2005 Patsalaridis ..... E04H 12/2223 248/530
2007/0108428 A1 * 5/2007 Sadinsky ..... E04H 12/2269 256/65.14
2007/0170412 A1 * 7/2007 Lee ..... E02D 27/42 256/59
2009/0025332 A1 * 1/2009 Richards ..... E04H 12/2269 52/704
2009/0320396 A1 * 12/2009 Knudsen ..... E04H 12/2269 52/297
2013/0061555 A1 * 3/2013 Knudsen ..... E04G 21/02 52/834
2013/0175422 A1 * 7/2013 Clarke ..... E04H 12/2269 248/523

FOREIGN PATENT DOCUMENTS

DE 10122789 A1 11/2002
FR 2747148 A1 10/1997

OTHER PUBLICATIONS

Written Opinion of the International Searching Authority dated Nov. 17, 2016 for corresponding International Application No. PCT/FR2016/052365, filed Sep. 19, 2016.
English translation of the Written Opinion of the International Searching Authority dated Nov. 17, 2016 for corresponding International Application No. PCT/FR2016/052365, filed Sep. 19, 2016.

* cited by examiner

SYSTEM FOR ANCHORING A POLE INTO THE GROUND COMPRISING AT LEAST ONE INTERFACE LIKELY TO BE ASSEMBLED ON AN ANCHORING BASE INTENDED TO BE FLUSH WITH THE GROUND

CROSS-REFERENCE TO RELATED APPLICATIONS

This Application is a Section 371 National Stage Application of International Application No. PCT/FR2016/052365, filed Sep. 19, 2016 and published as WO 2017/051099 on Mar. 30, 2017, not in English, and which claims priority to French Application FR1559091, filed Sep. 25, 2015, the contents of which are incorporated herein by reference in their entireties.

FIELD OF THE DISCLOSURE

The field of the invention is that of designing and producing outdoor equipment. More specifically, the invention relates to a system for anchoring a pole into the ground which enables to quickly and easily carry out the installation and the deinstallation of a pole.

The invention applies, in particular, but not exclusively, to anchoring outdoor area equipment poles into the ground (umbrellas, airers, etc.).

It is noted that the invention can also be applied in fields of sport (badminton and volleyball net poles, football goalposts, etc.), temporary installations (tents, gazebos, pole holding a showerhead for an outdoor swimming pool, etc), or again, anchoring (pole fitted with rings, hooks, etc.).

BACKGROUND OF THE DISCLOSURE

In the field of the invention, weighted umbrella bases are known. These umbrella bases comprise a weighted base, from which a receiving body extends, intended to receive an umbrella pole and to hold it in position, for example, using a screw.

This type of umbrella base enables to provisionally anchor an umbrella, but however exhibits disadvantages:

- it is heavy and difficult to move;
- it can exhibit problems with stability;
- it risks damaging a lawn whereon it would be positioned;
- it is cumbersome in the case where a person wants to mow the lawn whereon it is positioned.

Another solution, proposed by the prior art, consists of a ground-level type umbrella post anchoring. In this solution, a base is found which forms the receiving body, intended to receive an umbrella pole. This base has the specificity of being sunken into the ground and exhibiting a cavity which has a high end, flush with the level of the ground. Thus, all the user needs to do, is to arrange an umbrella pole inside the cavity to put the umbrella in place.

Thanks to this anchoring, a user does not need to handle a heavy base during the deinstallation of the umbrella. Also, a person who would wish to mow the lawn, does not need to worry about the base which is sunken into the ground, the latter not going beyond ground level. Finally, when the pole is installed, the base does not extend around the pole, above the ground and does not constitute an obstacle.

This solution, however, exhibits disadvantages. Indeed, poles which are inserted into the cavity of the base are not held in position. Thus, according to external stresses (slope, wind, etc.) an umbrella can fly away, turn, or lean to one side, which is not wanted.

SUMMARY

The invention, in particular, aims to compensate for the disadvantages of the prior art.

More specifically, the invention aims to propose a solution for anchoring a pole which is quick and simple to implement during the installation or the deinstallation of the pole.

The invention also aims to propose such a solution which enables to lock the position and the orientation of the anchored pole in position.

The invention again aims to propose such a solution which is not cumbersome when the pole is installed or uninstalled.

These aims, as well as others which will subsequently appear are achieved thanks to the invention which aims for a system for anchoring a pole into the ground comprising an anchoring base intended to be anchored into the ground, the anchoring base exhibiting a high, flush end, intended to be flush with the ground, characterised in that it comprises:

- at least one interface exhibiting a housing capable of holding a pole, the interface comprising means for holding a pole inserted in the housing thereof;
- means for assembling/disassembling the interface on the anchoring base, and in that the interface exhibits means for actuating the interface coupled with the assembly/disassembly means, the means for actuating the interface being mobile between at least two positions:

- a locking and inserting position, wherein the assembly/disassembly means lock the interface moving forward in the anchoring base along an insertion axis of the interface in the anchoring base;
- a position for releasing the interface in relation to the anchoring base.

Such an anchoring system is simple and quick to implement. Indeed, initially, a person must anchor the anchoring base into the ground, such that it is flush with the ground. Thereafter, a pole can be quickly anchored thanks to the interface. A person must, for example, assemble the interface on the anchoring base, then insert the pole into the interface housing.

To uninstall the pole, it can be sufficient for a person to disassemble the anchoring base interface. Thus, the pole can be uninstalled quickly and simply, and this, without leaving a cumbersome or heavy object which would constitute an obstacle on the ground (for example, for a lawnmower), or which would be ungainly.

Also, when the pole is installed, the anchoring system according to the invention does not exhibit a peripheral ballast extending above the ground. Thus, the anchoring system according to the invention exhibits a controlled obstruction when the pole is anchored.

Finally, the holding means enable to couple the pole to the interface. Thus, the pole is attached inside the interface and cannot turn inside the interface or be removed from it, without the voluntary action of a person.

Such as mentioned above, the pole intended to be anchored can, non-exhaustively, correspond to an umbrella pole, a pole intended to support a net or to support an outdoor element (gazebo, side table). The pole can again correspond to a solar stud pole (the high end of the pole exhibiting a lamp and a solar cell), to pole supporting a "fishing rod rest" type device, a pole exhibiting an attachment ring or a hammock pole.

It is also understood, that an anchoring system according to the invention offers a significant versatility. Indeed, one same base can receive a multitude of different interfaces, thus enabling to anchor varied equipment poles on one same anchoring base. The invention again enables to have several anchoring bases distributed in an outdoor area, and the change the position of a pole of a piece of equipment, by moving it from one anchoring base to another. For example, two poles supporting a net (badminton, volleyball net posts, etc.) can thus quickly be moved to adapt the arrangement of the court/pitch/field/area, to the orientation of the sun.

According to a first preferred embodiment, the interface is installed permanently on a pole, the interface taking the form of a ring, of which the housing is through-bore, the ring being capable of being crossed by the pole.

Thanks to this embodiment, an interface only needs to be installed one single time on a pole, such that the latter can be quickly coupled on the anchoring base. The anchoring system can thus comprise several interfaces to be permanently attached on different poles, so as to simply and quickly change the type of equipment anchored.

According to a second preferred embodiment, the interface is a module for poles of variable diameters, the means for holding the interface taking the form of a cylindrical body exhibiting the housing and comprising in an upper part:

- a radially deformable holding ring, capable of surrounding a pole;
- a means for actuating the holding ring, extending to radially deform the holding ring.

The interface thus takes a form, enabling to anchor different types of pole, and in particular, different types of umbrella. The means for actuating the holding ring can, for example, consist of a cap being screwed on the cylindrical body and deforming the holding ring, according to the screwing depth of the cap on the cylindrical body.

According to an advantageous characteristic, the assembly/disassembly means comprise:

- mortises located on one of either the interface or the anchoring base;
- additional mortise teeth located on the other of the interface or the anchoring base.

Such assembly/disassembly means are simple to implement and enable a quick assembly and disassembly. These means can, in particular, be of the removable type, such that the interface can be installed on the anchoring base by simply being inserted on top.

Preferably, the means for actuating the interface exhibit a locking, inserting and rotating position wherein the assembly/disassembly means lock the interface moving forward in the anchoring base along the insertion and rotation axis of the interface around the insertion axis.

These means for actuating the interface enable a person to simply install, adjust orientation or uninstall a pole.

Preferably, these means for actuating the interface take the form of two button located on either side of the interface, such that a user simply has to pinch the interface at the level of these two buttons to operate the assembly/disassembly means.

According to a preferred embodiment, the anchoring system comprises a shutter cover, capable of being coupled on the anchoring base, the shutter cover coupled on the anchoring base being intended to be flush with the ground.

The anchoring base can thus be closed when it is not used to anchor a pole. Thus, when the anchoring base is not used to anchor a pole, it can be protected from the outside environment by preventing, in particular, debris accumulating in the anchoring base.

According to an advantageous characteristic, the anchoring base takes the form of a spiral, intended to be screwed into the ground, and the shutter cover comprises a retractable handle for screwing the anchoring base.

The anchoring system thus takes an all-in-one form, particularly simple to implement by a user.

Of course, such an anchoring base can be sealed in the ground if a person wishes to install it permanently.

Preferably, the retractable handle is constituted by:

- a through bore extending orthogonally to an axis for screwing the anchoring base into the ground, the through bore being exhibited by a body of the shutter cover;
- a telescopic screwing bar, capable of being inserted in the through bore, and the anchoring base comprises a storage housing, capable of receiving and storing the telescopic screwing bar.

The user of the system thus has a retractable handle integrated at the anchoring base, in a particularly non-cumbersome manner. According to an example of installing such an anchoring base in the ground, all the user needs to do is:

- separate the shutter cover from the anchoring base to access the storage housing;
- remove the telescopic screwing bar from the storage housing and unfold it;
- couple the shutter cover on the anchoring base, such that the body of the shutter cover emerges from the anchoring base;
- insert the screwing bar into the through bore;
- position the anchoring base at a desired place on the ground and proceed with screwing the anchoring base using the screwing bar.

Advantageously, the shutter cover exhibits a spirit level. In this way, when a user proceeds with screwing the anchoring base into the ground, they have a visual marker which enables them to directly make sure that the anchoring base is anchored straight in the ground.

BRIEF DESCRIPTION OF THE DRAWINGS

Other characteristics and advantages of the invention will appear more clearly upon reading the following description of preferred embodiments of the invention, given as illustrative and non-exhaustive examples, and the appended drawings, amongst which.

DETAILED DESCRIPTION OF ILLUSTRATIVE EMBODIMENTS

Figure 1:
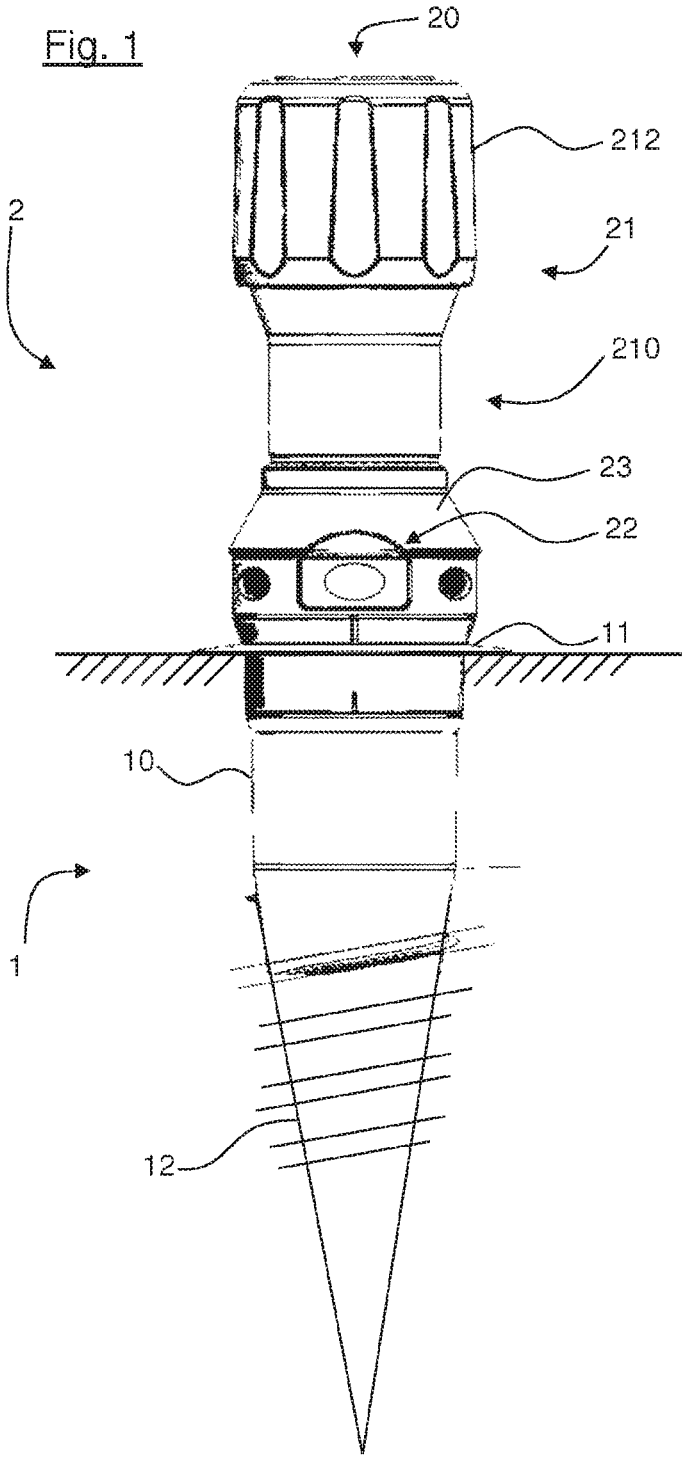
FIG. 1 is a schematic representation of the anchoring system according to the invention having an interface for poles with variable diameters.

Such as illustrated by FIG. 1, a system for anchoring a pole in the ground according to the invention comprises:

- an anchoring base 1 intended to be inserted and coupled in the ground;
- at least one interface 2 likely to be assembled or disassembled from the anchoring base and intended to receive and hold a pole.

The anchoring base comprises, more specifically, a central cylindrical part 10 exhibiting a high, flush end, formed by a sleeve 11. This high, flush end is thus intended to be flush with the ground, once the anchoring base is anchored in the ground.

Preferably, the sleeve 11 extends around the anchoring base so as to keep the part of the anchoring base intended to receive the interface unobstructed. This sleeve thus enables to avoid the development and/or the positioning of foreign bodies (grass, dirt, etc.) between the anchoring base and an interface brought opposite the anchoring base to be assembled on top.

This anchoring base can, in particular, take a spiral form. In this case, the central cylindrical part 10 is extended by a threaded cone 12. Such an anchoring base can thus be screwed into the ground along a screwing axis. This anchoring base can also be sealed in the ground if the user deems it necessary.

Preferably, the central cylindrical part and the threaded cone are made of aluminium.

Figure 2:
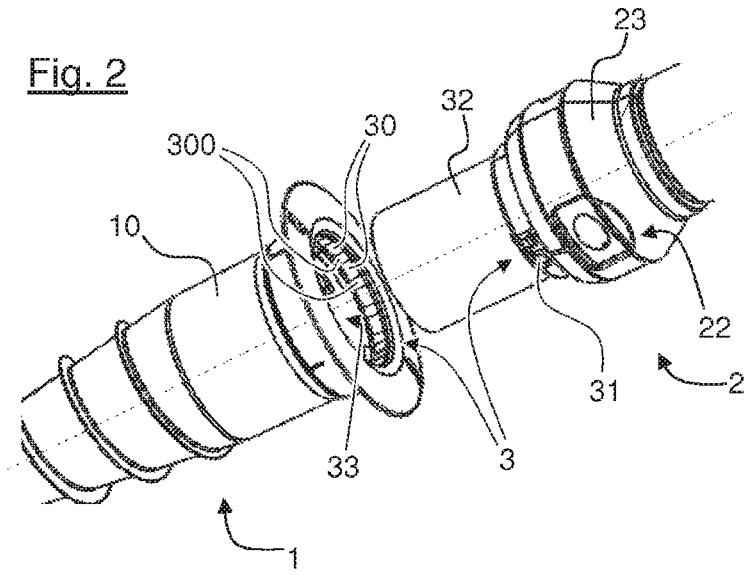
FIG. 2 is a schematic representation of an anchoring base and an interface, disassembled from the anchoring base.
Figure 3:
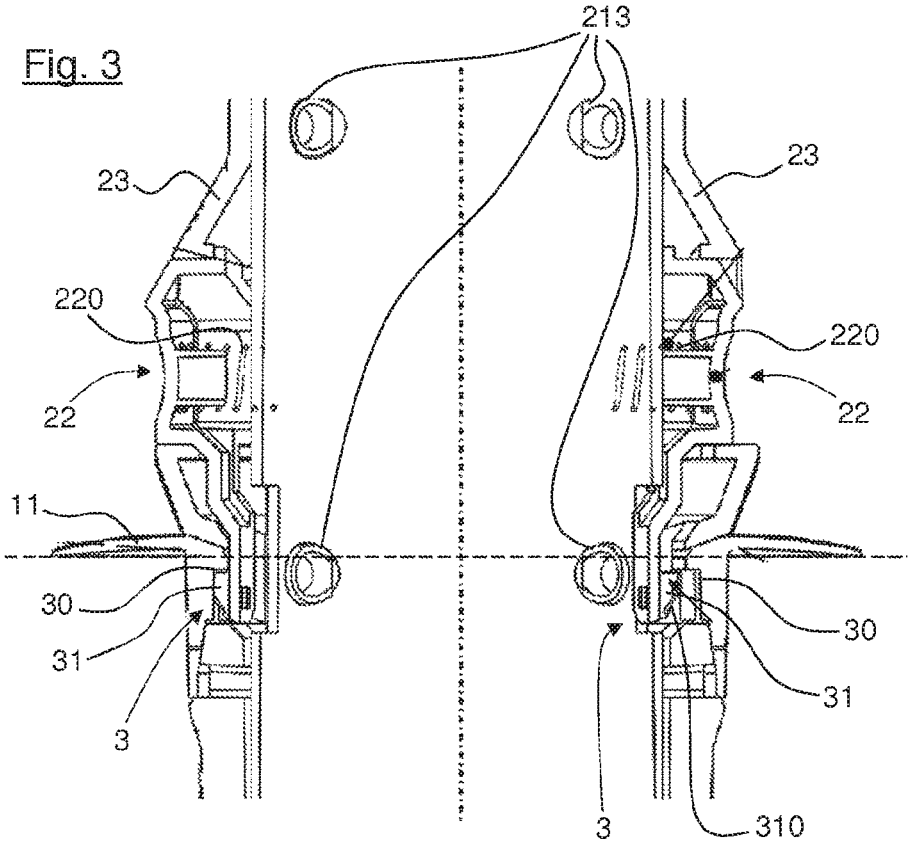
FIG. 3 is a schematic representation according to a cross section of the means for assembling/disassembling an anchoring system according to the invention.

According to the principle of the invention and such as illustrated by FIGS. 2 and 3, the anchoring system comprises means for assembling/disassembling 3 the interface 2 on the anchoring base 1, and means for actuating the interface 22 coupled with the assembly/disassembly means 3.

These assembly/disassembly means in particular comprise mortises 30 and additional teeth 31.

According to the present embodiment, the mortises are located on the anchoring base 1 and the additional teeth 31 are located on the interface 2.

The assembly/disassembly means also comprises an additional male cylindrical part 32 of a female cylindrical cavity 33. More specifically, the female cylindrical cavity 33 is formed by the central cylindrical part 10 of the anchoring base 1. In itself, the male cylindrical part is formed by the interface 2 or by a pole crossing the interface such as subsequently explained in more detail.

Thus, to carry out the assembly of the interface on the anchoring base, the male cylindrical part is first inserted into the female cylindrical cavity along an insertion axis of the interface in the anchoring base, then the teeth cooperate with the mortises to finalise the assembly.

The means for actuating the interface 22 are exhibited by the interface 2, and, such as will be subsequently defined in more detail, in particular take the form of buttons located on either side of the interface. These means for actuating the interface are mobile between at least three positions:

- a position for releasing the interface;
- a position for locking and inserting the interface;
- a position for locking and rotating the interface.

In the releasing position, the interface can be freely removed from the anchoring base.

In the position for locking, inserting and rotating the interface, the assembly/disassembly means thus lock the interface moving forward in the anchoring base along the insertion axis, but also rotating the interface around the insertion axis.

Finally, the locking and inserting position is an intermediary position between the two preceding positions, in this position, the assembly/disassembly means only lock the interface 2 moving forward in the anchoring base 1 along the insertion axis.

Figure 7:
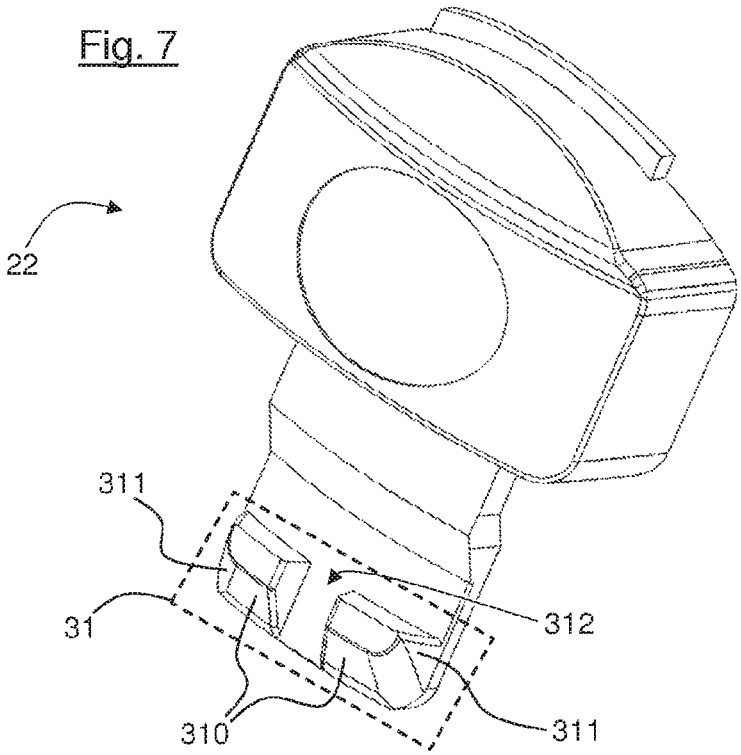
FIG. 7 is a schematic representation according to a perspective view of a button of an interface of an anchoring system according to the invention.

Such as can be observed in FIGS. 3 and 7, the means for actuating the interface 22 are thus buttons located on either side of the interface, these buttons carrying teeth 31. These buttons are radially mobile in a shell 23 of the interface and exhibit underlying springs 220 which enable them to be returned, with there being no external stress, in a position distant from the centre of the interface.

According to FIG. 3, the button on the left-hand part of the figure is in a locking, inserting and rotating position which is a rest position, and the button on the right-hand part of the figure is in a releasing position.

It can be observed in FIGS. 3 and 7, that the teeth 31 exhibit a first bevel 310 intended to come into contact with the sleeve 11. Thus, when the interface 2 is inserted on the anchoring base, the teeth 31 come into contact with the sleeve 11. Consequently, by continuing the insertion of the interface, the first bevel of the teeth leads to a centripetal deformation of the buttons. Once the teeth have crossed the thickness of the sleeve, the buttons can return to a distant position and the teeth thus enable to clip the interface in position on the anchoring base.

Figure 8:
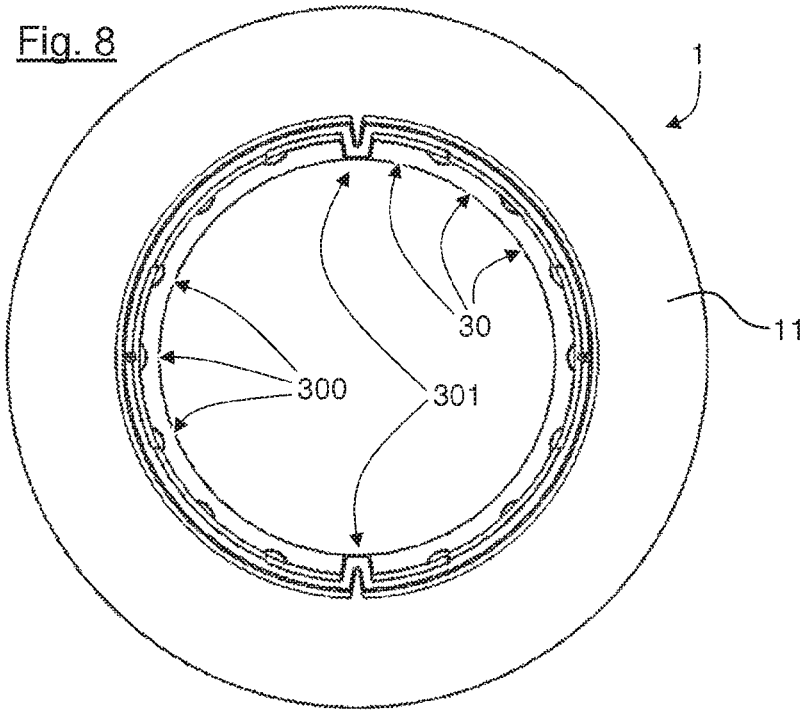
FIG. 8 is a schematic representation according to a top view, of an anchoring base of a system according to the invention.

According to the present embodiment illustrated by FIGS. 2, 7 and 8:

- the additional mortises 30 of the teeth 31 are separated by indexing platforms 300 and/or rotating blocking stoppers 301, and
- each tooth 31 can cooperate with two adjacent mortises 30 and exhibits a central notch 312, additional to the indexing platforms and the rotating blocking stoppers.

Thus, when the teeth are completely sunken into the mortises 30, and when they cooperate with the rotating blocking stoppers, the interface is locked and inserted along the insertion axis and rotated around the insertion axis.

Figure 6:
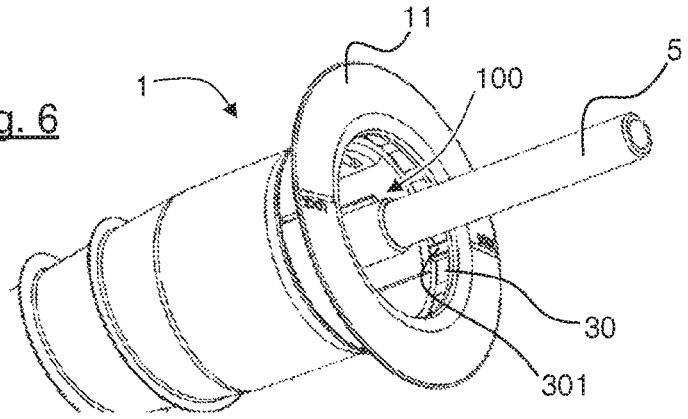
FIG. 6 is a schematic representation of an anchoring base according to the invention with a telescopic screwing bar emerging from the storage housing of the anchoring base.

Such as can be observed in FIGS. 2, 6 and 8, the mortises 30, the indexing platforms and/or the rotating blocking stoppers are exhibited by a grooved wheel located inside the anchoring base 1, on the sleeve 11 or in the immediate proximity of the sleeve.

When the means for actuating the interface are in the intermediary locking and inserting position, the interface can rotate around the insertion axis and the central notches of the teeth can thus cooperate with the indexing platforms so as to give rotating markers of the interface in relation to the anchoring base.

Such as illustrated by FIG. 8, the indexing platforms 300 have a curved form, capable of exerting a resistance to teeth passing, without for all that, blocking them from rotating when they cooperate with the central notch of the teeth. According to the same figure, it is observed that the rotating blocking stoppers 301 have a protruding form, capable of being fitted with the central notch of the teeth.

According to the preferred embodiment illustrated by FIG. 7, the teeth 31 exhibit second bevels 311, located on the side of the teeth, capable of cooperating with the indexing platforms. These second bevels enable the teeth to facilitate crossing the indexing platforms without a user pressing the buttons. The indexing is thus felt by the user, who feels an immediate resistance to the rotation of the interface around the insertion axis when the teeth cross the indexing platforms.

The second bevels 311 are also capable of cooperating with the rotating blocking stoppers. Thus, the teeth 31 can cross a rotating blocking stopper 301 without a user having to press the buttons. During the crossing of a rotating blocking stopper, the central notch 312 of the tooth will thus come opposite the rotating blocking stopper and will thus be fitted with it. Thanks to this fitting and to the additional forms of the central notch and of the rotating blocking stopper, the interface can thus no longer turn in rotation around the insertion axis, if a user does not press the buttons at the same time.

For example, the indexing platforms can be designed so as to create markers every 10° or 22° angle.

Figure 4:
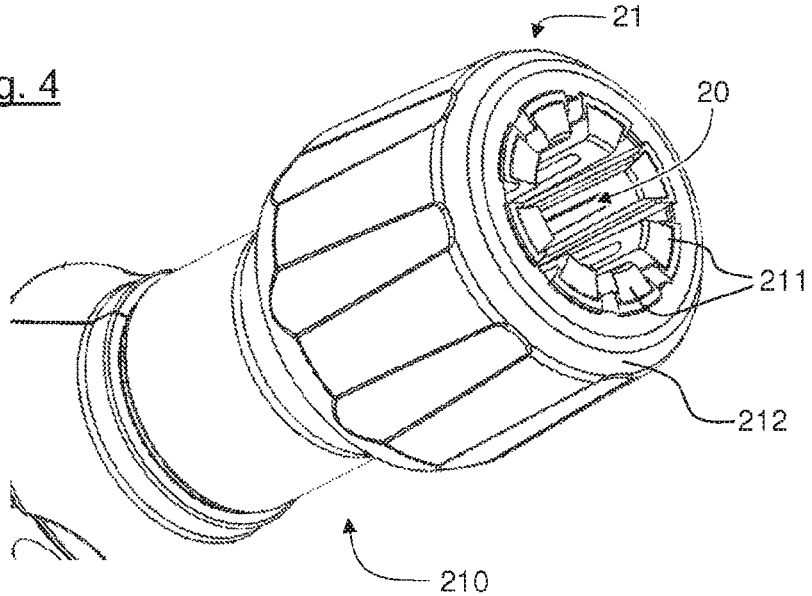
FIG. 4 is a schematic representation according to a top view of an interface for poles with variable diameters.

According to a characteristic of the invention, illustrate in particular by FIGS. 1, 2 and 4, the interface 2 exhibits a housing 20 which is capable of and intended to hold a pole to be anchored. The interface also comprises means for holding 21 the pole held in the housing.

Figure 9:
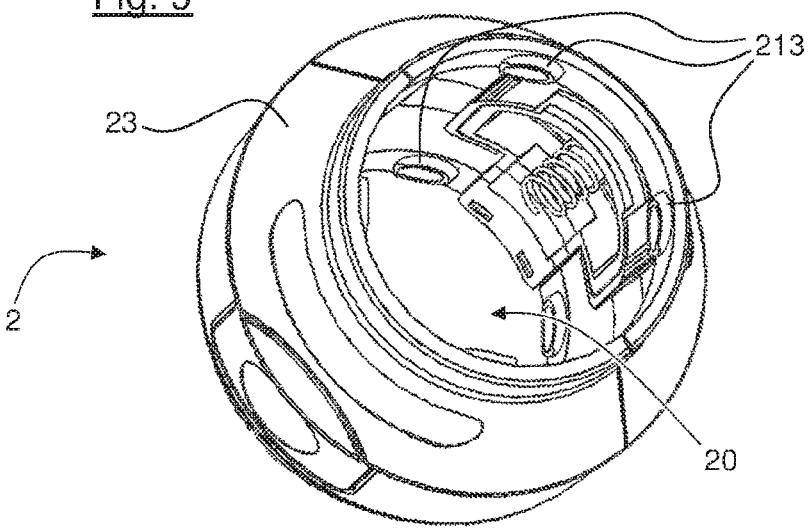
FIG. 9 is a schematic representation according to a perspective view of an embodiment of an assembled interface, taking the form of a ring.
Figure 10:
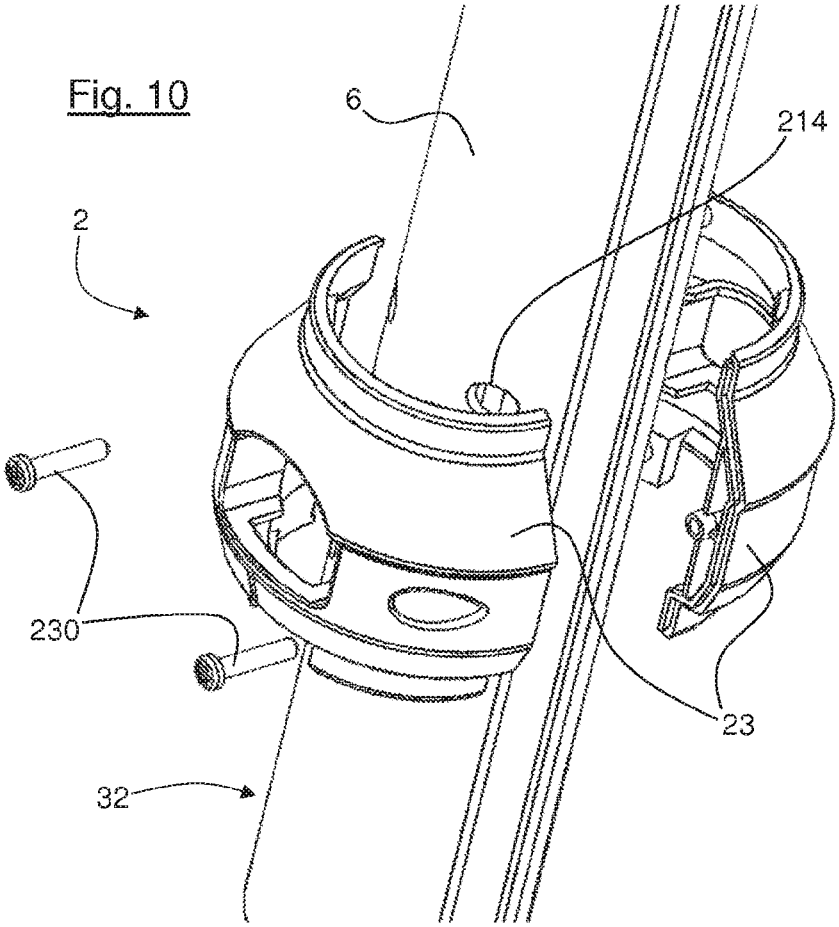
FIG. 10 is a schematic representation according to an exploded view of an interface such as illustrated by FIG. 9, before assembly around a pole.

According to a first embodiment, illustrated, for example, by FIGS. 9 and 10, the interface 2 is installed permanently on a pole 6. It thus takes the form of a ring, constituted by the shell 23 of the interface. The housing 20 exhibited by the interface is thus of the through-bore type. The interface 2 can thus be threaded or assembled on the pole 6 to be anchored. In this case, such as can be observed in FIG. 10, the male cylindrical part 32 is formed by the end of the pole 6 which crosses the ring. Also, the holding means take the form of lugs 213 extending towards the inside of the housing, intended to cooperate with the additional bored holes 214 made in the pole 6.

Such as can be observed in FIG. 10, the shell 23 of the interface 2 made of two parts to be assembled around the pole. To carry out the assembly, the screws 230 are intended to be screwed through these two parts.

According to a second embodiment illustrated by FIGS. 1 to 4, the interface 2 is a module for poles with variable diameters. In other words, the interface enables to anchor poles of which the diameter is within a range of predetermined values. According to this embodiment, the means for holding 21 the interface 2 take the form of a cylindrical body 210 exhibiting the housing 20. The cylindrical body also comprises, in an upper part, a holding ring 211 which is radially deformable so as to surround a pole, and a means for actuating the holding ring 212.

The means for actuating the holding ring 212 can take the form of a screwed cap, enabling to radially deform the holding ring. This deformation occurs by screwing the cap on the cylindrical body, compressing in this way, the holding ring to deform it centripetally.

Preferably, and such as illustrated by FIGS. 2 to 4, the cylindrical body 210 extends towards the bottom so as to form the male cylindrical part 32. The interface 2 thus also comprises the shell form 23 in annular form. This shell 23 is intended to be assembled on an intermediary section of the cylindrical body 210. Lugs 213 are found, which thus enable to hold the shell 23 in position on the intermediary section of the cylindrical body 210.

According to this latter preferred embodiment, it is understood that the shell of the interface can thus be used to produce an interface "to be installed permanently on a pole" or an interface of the "module for poles with variable diameters" type. In this way, the production of the anchoring system is simplified, and the production costs can be limited.

Figure 5:
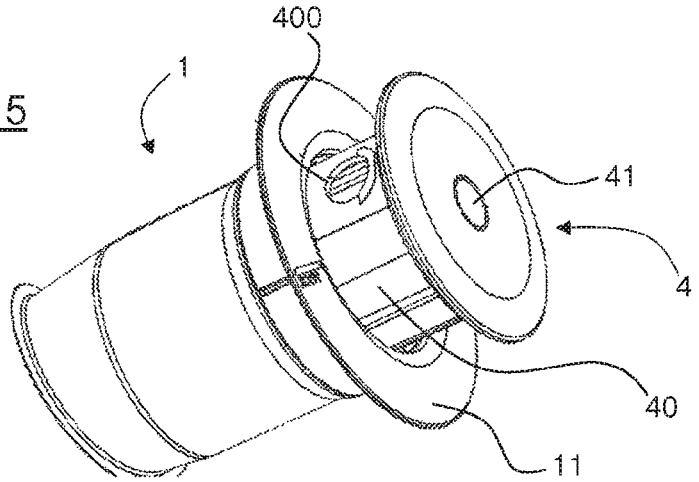
FIG. 5 is a schematic representation of the anchoring base having a shutter cover positioned such that the body thereof emerges from the anchoring base.

Such as illustrated by FIG. 5, the anchoring system also comprises a shutter cover 4.

This shutter cover can be coupled on the anchoring base instead of an interface. This shutter cover thus enables to close the anchoring base when the latter is not assembled with an interface to anchor a pole.

When this shutter cover is coupled with the anchoring base, it is intended, in a closing position, to be flush with the ground, stable in the sleeve 11.

According to the present embodiment, this shutter cover exhibits more specifically a body 40 intended to cooperate with the female cylindrical cavity of the anchoring base.

In the case where the anchoring base must be screwed into the ground, the shutter cover 4 thus comprises a retractable handle, enabling to facilitate the screwing, and a spirit level 41 enabling to make sure that the anchoring base is screwed straight into the ground.

This retractable handle is more specifically constituted by a through bore 400 exhibited by the body 40 of the shutter cover 4 and by a screwing bar being inserted in the through bore. More specifically, the through bore extends orthogonally in relation to the axis for screwing the anchoring base into the ground. Thus, the screwing bar inserted in the through bore itself also extends orthogonally in relation to the screwing axis, thus facilitating said screwing of the anchoring base into the ground.

Preferably, the screwing bar exhibits a flat spot, capable of blocking the screwing bar rotating inside the through bore. The screwing bar thus designed enables to increase the holding of the anchoring base when screwing by a user, and in particular, it enables to avoid the anchoring base being offset from the screwing axis by the force exerted by a user during the very first occasions of screwing.

Such as can be observed in FIG. 6, the screwing bar is a telescopic screwing bar 5, which can be stored inside the anchoring base 1, within a storage housing 100. Such a design enables the processing and packaging of an anchoring base to be simplified for the commercialisation thereof.

According to this design, if a person wishes to proceed with screwing the anchoring base into the ground, and to close it, they can proceed in the following way:

- remove the shutter cover;
- remove the screwing bar from the storage housing;
- couple the shutter cover on the anchoring base, according to a screwing position wherein the body of the shutter cover emerges from the anchoring base;
- insert the screwing bar in the through bore exhibited by the body of the shutter cover;
- screw the anchoring base using the retractable handle (the screwing bar) until the sleeve (high, flush end) of the anchoring base is flush with the ground;
- remove the screwing bar and the shutter cover;
- couple the shutter cover on the anchoring base according to the closing position wherein the shutter cover is stable in the sleeve and itself is flush with the ground.

Incidentally, if the interface and the pole(s) which will be coupled on the anchoring base are hollow and compatible, the screwing bar can thus be reinserted in the storage housing. However, preferably, and to avoid any incompatibility with the interface or the solid poles, the screwing bar is not reinserted in the storage housing after the anchoring base has been screwed into the ground.

Although the present disclosure has been described with reference to one or more examples, workers skilled in the art will recognize that changes may be made in form and detail without departing from the scope of the disclosure and/or the appended claims.

The invention claimed is:

1. A system for anchoring a pole into a ground surface, the system comprising:

an anchoring base configured to be anchored into the ground surface, the anchoring base having a high, flush end, arranged to be flush with the ground surface, wherein the anchoring base includes a sleeve, which comprises:

a cylindrical part; and an external flange located at the high, flush end of the anchoring base and extending from a top end of the cylindrical part perpendicularly to a longitudinal axis of the anchoring base into the ground surface, a bottom side of the external flange forming a support surface for the ground surface and the external flange being arranged to be flush with the ground surface;

at least one interface having a housing capable of holding the pole, the interface having a holding element configured to hold the pole inserted in the housing thereof;

assembly and disassembly elements, which assemble and disassemble the interface on the anchoring base, wherein the interface comprises an actuator, which actuates the interface coupled with the assembly and disassembly elements, the actuator being mobile between at least two positions:

a locking and inserting position, wherein the assembly and disassembly elements lock the interface moving forward in the anchoring base along an insertion axis of the interface in the anchoring base;

a position for releasing the interface in relation to the anchoring base.

2. The system according to claim 1, wherein the assembly and disassembly elements comprise:

a first part on the anchoring base, at or below the high, flush end;

a second part on the interface, wherein second part cooperates with the first part at or below the high, flush end of the anchoring base, and wherein the first part passes through an opening of anchoring base, along the insertion axis of the interface in the anchoring base, to cooperate with the second part.

3. The system according to claim 1, wherein the interface is installed permanently on the pole, the interface taking the form of a ring of which the housing is through-bore, the ring being capable of being crossed by the pole.

4. The system according to claim 1, wherein the interface is a module for poles with variable diameters, the holding element taking the form of a cylindrical body forming the housing and comprising in an upper part:

a radially deformable holding ring capable of surrounding the pole;

a holding ring actuator, which actuates the holding ring by extending to radially deform the holding ring.

5. The system according to claim 1, wherein the assembly and disassembly elements comprise:

mortises located on one of either the interface or the anchoring base;

additional mortise teeth located on the other of the interface or the anchoring base.

6. The system according to claim 1, wherein the actuator that actuates the interface comprises a locking, inserting and rotating position wherein the assembly and disassembly elements lock the interface moving forward in the anchoring base along the insertion and rotation axis of the interface around the insertion axis.

7. The system according to claim 1, further comprising a shutter cover capable of being coupled on the anchoring base, the shutter cover coupled on the anchoring base being arranged to be flush with the ground surface.

8. The system according to claim 7, wherein the anchoring base takes the form of a spiral that is capable of being screwed into the ground surface, and wherein the shutter cover comprises a retractable handle to screw the anchoring base.

9. The system according to claim 8, wherein the retractable handle is constituted by:

a through bore extending orthogonally to an axis for screwing the anchoring base into the ground surface, the through bore being formed by a body of the shutter cover;

a telescopic screwing bar, capable of being inserted in the through bore, and wherein the anchoring base comprises a storage housing, capable of receiving and storing the telescopic screwing bar.

10. The system according to claim 8, wherein the shutter cover comprises a spirit level.

* * * * *